United States Patent [19]

Takahashi et al.

[11] 4,412,945

[45] Nov. 1, 1983

[54] AQUEOUS HIGH CONCENTRATION SLURRY OF ALCOHOL ETHOXYLATE

[75] Inventors: Masatoshi Takahashi, Fujisawa; Mituo Sugiyama, Tokyo; Osamu Toisawa, Chiba; Yasuo Ishizaki, Tokyo, all of Japan

[73] Assignee: Lion Corporation, Tokyo, Japan

[21] Appl. No.: 336,827

[22] Filed: Jan. 4, 1982

[51] Int. Cl.[3] ..... C11D 1/831; C11D 1/14

[52] U.S. Cl. ..... 252/551; 252/536; 252/174.21; 252/DIG. 14

[58] Field of Search ..... 252/536, 551, DIG. 14, 252/174.21

[56] References Cited

U.S. PATENT DOCUMENTS

| | | | |
|---|---|---|---|
| 3,574,125 | 4/1971 | van Paassen | 252/551 |
| 3,919,125 | 11/1975 | Ashina et al. | 252/551 |
| 3,960,780 | 6/1976 | Murata et al. | 252/532 |
| 4,029,608 | 6/1977 | Murata et al. | 252/551 |
| 4,316,824 | 2/1982 | Pancheri | 252/551 |

FOREIGN PATENT DOCUMENTS 56-65098 6/1981 Japan .

*Primary Examiner*—P. E. Willis, Jr.

*Attorney, Agent, or Firm*—Armstrong, Nikaido, Marmelstein & Kubovcik

[57] ABSTRACT

A high concentration surfactant slurry, containing at least 50 wt. % of a higher alcohol ethoxylate sulfate salt, is provided. This slurry has incorporated therein a polyoxyethylene alkyl ether having an average molecular weight of about 4,000 to 10,000 and an alkyl group of 8–16 carbon atoms. The slurry has a reduced viscosity and is not affected by the temperature, with the result that it can be handled easily at low temperatures. It also exhibits no phase separation, even when it is stored over a long period of time.

5 Claims, No Drawings

AQUEOUS HIGH CONCENTRATION SLURRY OF ALCOHOL ETHOXYLATE

BACKGROUND OF THE INVENTION (1) Field of the Invention

This invention relates to a high concentration surfactant slurry having a reduced viscosity. More particularly, it relates to a high concentration surfactant slurry containing at least 50% by weight of a higher alcohol ethoxylate sulfate salt as an effective surfactant ingredient, in which a special additive has been incorporated whereby the slurry viscosity is reduced and the storage stability is enhanced.

(2) Description of the Prior Art

A salt of a higher alcohol ethoxylate sulfate (which salt is hereinafter referred to as "AES" for brevity) is ordinarily used in the form of a homogeneous transparent solution, containing AES at a concentration lower than the solubility in order to ensure the homogeneity of the quality. However, from the viewpoints of increasing the efficiency of utilization of a storage tank and making the transportation of the slurry more economical, and in order to increase the drying efficiency and reduce the quantity of heat when AES is used as the raw material for a granular detergent, it is preferred that AES be used in the form of a high concentration slurry. A high concentration slurry of such a surfactant has a high viscosity and is difficult to handle. Therefore, it is necessary to reduce the viscosity of the slurry. From the viewpoint of easiness in handling, it is ordinarily desired that such a high concentration surfactant slurry should have a viscosity lower than 80 poises at a temperature of from 25° to 60° C. A high concentration AES slurry containing at least 50% by weight of AES is used for heavy detergents, light detergents, shampoos, or the like. When the slurry is used for such purposes, it is also desired that the properties of the slurry should not be affected by the temperature of the slurry and that the slurry should be able to be handled easily at low temperatures.

As means for solving these problems, there is known a method in which polyethylene glycol is added to the slurry (see Japanese Laid-Open Patent Application No. 116,383/75). Furthermore, we previously found that a high concentration AES slurry, having incorporated therein a salt of a polyethylene glycol sulfuric acid diester having a specific molecular weight (Japanese Laid-Open Patent Application No. 36,596/81) or a polyoxyethylene glyceryl ether (Japanese Patent Application No. 22,549/80), has a reduced viscosity and is not affected by temperature and this slurry can be handled easily at low temperatures.

These merits of the low viscosity, high concentration AES slurry containing the above additive are sufficiently manifested when the slurry is used within a short period from the preparation thereof or is stored in a storage tank equipped with a stirrer; but, when the slurry is stationarily stored for a long time, undesirable phase separation takes place and the quality becomes non-uniform. Therefore, if the slurry is stored for a long time in drums or other containers, the commercial value is drastically lowered.

SUMMARY OF THE INVENTION

It is, therefore, a primary object of the present invention to provide a high concentration AES slurry which has a reduced viscosity, is not affected by temperature, can be handled easily at low temperatures and which exhibits no phase separation, even when it is stored over a long period of time.

In accordance with the present invention, there is provided an improved high concentration surfactant slurry comprising at least 50% by weight of a higher alcohol ethoxylate sulfate salt, based on the weight of the slurry, which slurry is characterized by containing a polyoxyethylene alkyl ether having an average molecular weight of about 4,000 to about 10,000, the alkyl group of which has 8 to 16 carbon atoms.

DESCRIPTION OF THE PREFERRED EMBODIMENTS

As the higher alcohol used as the raw material for the preparation of AES contained as the effective surfactant ingredient of the slurry of the present invention, there can be mentioned products which are obtained by reducing natural animal and vegetable oils and fats and those which are obtained according to known synthetic processes, such as the Ziegler process, the oxo process and the paraffin direct oxidation process. The higher alcohols may be either of a linear or branched chain structure, and preferably have an alkyl group of 9 to 18 carbon atoms. Among these higher alcohols, there is, preferably, a long-chain branched alcohol, represented by the following general formula (I) or (II), or a long-chain alcohol mixture containing at least 35% by weight of the long-chain branched alcohol of the formula (I) or (II):

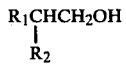

$$R_1CHCH_2OH \quad (I)$$
$$\quad\;\; | \;\; R_2$$

wherein $R_1$ and $R_2$ stand for an alkyl group, the carbon number of $R_1$ being from 1 to 3 and the sum of the carbon numbers of $R_1$ and $R_2$ being from 7 to 18, or

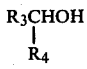

$$R_3CHOH \quad (II)$$
$$\quad\;\; | \;\; R_4$$

wherein $R_3$ and $R_4$ stand for an alkyl group, the carbon number of $R_3$ being from 1 to 9 and the sum of the carbon numbers of $R_3$ and $R_4$ being from 8 to 19.

The number of moles of ethylene oxide added to the higher alcohol for the preparation of AES is not more than 10 and, preferably, not more than 5.

AES may be prepared according to known conventional processes. For example, AES may be prepared by reacting a corresponding higher alcohol ethoxylate with chlorosulfonic acid or sulfuric anhydride and neutralizing the resulting reaction product with a neutralizing agent. The neutralizing agent includes, for example, inorganic bases such as sodium hydroxide, potassium hydroxide and magnesium hydroxide; and organic bases, such as ammonia and ethanol amine.

The high concentration AES slurry of the present invention may be prepared by incorporating the specified polyoxyethylene alkyl ether into a high concentration AES slurry prepared in advance. However, according to a preferred embodiment, in order to control the increase of the viscosity occurring immediately after neutralization of the sulfuric acid ester, an aqueous solution containing 1 to 30% by weight of a polyoxyethylene alkyl ether is added to the sulfuric acid ester together with an alkali, whereby the intended high concentration AES slurry can be obtained.

The polyoxyethylene alkyl ether used for the preparation of the slurry of the present invention may be prepared by reacting a corresponding alcohol with ethylene oxide in the presence of an alkali or acid catalyst, according to customary procedures. From the viewpoint of storage stability, the carbon chain length of the alkyl group (i.e., the alkyl group in the starting alcohol) in the polyoxyethylene alkyl ether should be selected so that the carbon number of the carbon chain is in the range of from 8 to 16. The alkyl group may be either linear or branched. If the carbon number of the alkyl group is 7 or less, or 17 or larger, the dispersion stability of the resulting high concentration AES slurry is impaired when it is stored for a long time, and the objects of the present invention cannot be achieved.

The average molecular weight of the polyoxyethylene alkyl ether is from about 4,000 to about 10,000. If the average molecular weight is lower than 4,000, the storage stability of the high concentration AES slurry is good, but the viscosity-reducing effect is not sufficiently manifested. When the average molecular weight is higher than 10,000, both the viscosity-reducing effect and the dispersion stability are good, but the melting point of the polyoxyethylene alkyl ether is increased to an undesirable extent, and the preparation of the polyoxyethylene alkyl ether becomes difficult.

The polyoxyethylene alkyl ether is incorporated in an amount of 0.05 to 10% by weight, preferably 0.1 to 5% by weight, based on the total weight of the slurry. When it is intended to obtain a higher viscosity-reducing effect and a longer storage stability or when the AES concentration in the slurry is increased, the amount of the polyoxyethylene alkyl ether added should be appropriately increased.

In the present invention, the high concentration AES slurry is defined as one having an AES content of at least 50% by weight. In general, the content of AES in the slurry of the present invention is in the range of from 50 to 80% by weight, more preferably 65 to 80% by weight, based on the weight of the slurry. In the slurry of the present invention, water is ordinarily used as a main dispersion medium, but in some cases, a mixture of water and oil may be used as a dispersion medium. A small amount of an inorganic salt may be incorporated in the slurry of the present invention.

As in the case of ordinary liquids, the viscosity of an AES slurry is apt to increase as the temperature is lowered. Especially in case of a high concentration AES slurry having an AES ingredient concentration of 65 to 80% by weight, handling or pumping transportation becomes very difficult in winter or in cold districts. The high concentration AES slurry of the present invention is characterized in that an increase of the viscosity is effectively controlled not only at high temperatures, but also at low temperatures. Furthermore, in the AES slurry of the present invention, although the concentration is high, the viscosity is reduced to a very low level, and therefore, pumping transportation or handling of the slurry of the present invention can remarkably be facilitated and the slurry can be widely used as the starting AES material for the production of various detergents. Furthermore, since the slurry can be supplied at a high concentration, the efficiency of utilization of a storage tank can be increased and the packaging and transportation costs can be reduced. Moreover, since the viscosity is reduced, no substantial loss is caused when the slurry is transported through a pipe or transferred from a vessel.

When AES prepared from a long-chain branched alcohol represented by the above general formula (I) or (II) or a long-chain alcohol mixture containing at least 35% by weight of the long-chain branched alcohol of the formula (I) or (II) is used, in addition to the above-mentioned advantages of having a reduced viscosity at which the liquid flows easily and increasing the storage stability, there is also the advantage that the slurry is easily soluble in the case where it is diluted with water to form an aqueous solution.

The main use of the high concentration AES slurry of the present invention is as a starting material for heavy detergents, light detergents, shampoos, and the like.

When the high concentration AES slurry of the present invention is used as the starting material of a granular detergent, since the water content of the slurry is low, drying can be effected with an enhanced efficiency at the spray drying step, and the amount of fuel oil, used for drying the slurry, can be considerably lessened. Moreover, in the high concentration AES slurry of the present invention, the contents of inorganic salts, such as sodium chloride and sodium sulfate, are very low, and, therefore, the slurry can be widely used as a starting material for liquid detergents, shampoos, rinsing compositions, or the like.

The present invention will now be described in detail with reference to the following Examples. In these Examples, all of "%" are by weight, unless otherwise indicated, and the viscosity is a value as measured by using a Brookfield viscometer after 3 minutes' rotation at a rotor rotation number of 12 r.p.m.

EXAMPLE 1

Using industrial-scale sulfonation equipment of the continuous thin film flow-down type according to the sulfuric anhydride process, a higher alcohol ethoxylate (the average number of moles of ethylene oxide added being 3.0) of an oxo alcohol having 12 to 15 carbon atoms and a branching degree of 20% (tradename "Dobanol 25") was sulfonated. The sulfonated product was continuously neutralized with an aqueous sodium hydroxide solution by using a jet mixer to obtain a slurry containing 85% of AES-Na, 0.7% of the unreacted oil component and 1.1% of sodium sulfate, and having a pH value of 7.0.

In a pressure-resistant glass autoclave, a predetermined type of alcohol and an aqueous 20% solution of sodium hydroxide in an amount of 0.2% based on the alcohol were charged, and the mixture was gradually heated in vacuo and dehydrated for 30 minutes under final conditions of a temperature of 80° to 90° C. and a pressure of 10 mmHg.

The inside atmosphere of the reaction vessel was replaced by $N_2$ and ethylene oxide was added at a temperature of 130°±5° and a pressure of 1 to 3 atmospheres, and, at this temperature, the reaction mixture was stirred and aged for 30 minutes to prepare a polyoxyethylene alkyl ether having a predetermined averge molecular weight. The so-prepared polyoxyethylene alkyl ether was used in the form of an aqueous 25% solution.

Each of the additives shown in Table 1 (which includes the above-mentioned polyoxyethylene alkyl ether) was added to the above-mentioned AES-Na to obtain a slurry having a composition shown below. The viscosity and storage stability of the slurry were determined, with the results shown in Table 1. Incidentally, in Table 1, "$\overline{MW}$" indicates the average molecular weight.

| Composition of Slurry | |
|---|---|
| Component | Content |
| AES-Na | 70% |
| Additive | 0.5% |
| Sodium sulfate, unreacted oil and water | Balance |

TABLE 1

| Run No. | Additive | | Separation Percentage (%)*1 25° C., 2 months | 45° C., 1 month | Viscosity (poises, 60° C.) |
|---|---|---|---|---|---|
| Present Invention | | | | | |
| 1 | Polyoxyethylene octyl ether | ($\overline{MW}$ = ca 6,000) | 0 | 0 | 72 |
| 2 | Polyoxyethylene lauryl ether | ($\overline{MW}$ = ca 6,000) | 0 | 0 | 70 |
| 3 | Polyoxyethylene palmityl ether | ($\overline{MW}$ = ca 6,000) | 0 | 0 | 75 |
| 4 | Polyethoxylate of $C_{12}$–$C_{13}$ alcohols | ($\overline{MW}$ = ca 6,000) | 0 | 0 | 72 |
| 5 | Polyethoxylate of $C_{12-15}$ alcohols | ($\overline{MW}$ = ca 6,000) | 0 | 0 | 72 |
| Comparison | | | | | |
| 6 | Polyoxyethylene glyceryl ether | ($\overline{MW}$ = ca 6,000) | 2.8 | 0.8 | 70 |
| 7 | Sodium polyoxyethylene glycol disulfate | ($\overline{MW}$ = ca 6,000) | 3.5 | 1.8 | 75 |
| 8 | Polyethylene glycol | ($\overline{MW}$ = ca 6,000) | 3.0 | 1.0 | 85 |

Note *1 350 g of the sample was charged in a cylindrical glass bottle, the bottle was sealed and the sample was allowed to stand still for a predetermined time, and the separation percentage was measured.

From the results shown in Table 1, it will readily be understood that the AES-Na slurry containing the polyoxyethylene alkyl ether incorporated therein, according to the present invention, is excellent over comparative samples in long-period storage stability and, since the slurry according to the present invention has a reduced viscosity, it can be handled very easily.

EXAMPLE 2

The carbon number of the alkyl group and the number of moles of ethylene oxide added in the polyoxyethylene alkyl ether were varied, and influences of these factors on the effect attained by addition of the polyoxyethylene alkyl ether were examined. More specifically, various polyoxyethylene alkyl ethers shown in Table 2 were independently added to the AES-Na used in Example 1 to obtain slurries having a composition shown below.

| Composition of Slurry | |
|---|---|
| Component | Content |
| AES-Na | 68% |
| Polyoxyethylene alkyl ether | 0.5% |
| Sodium sulfate, unreacted oil and water | Balance |

The viscosities of these slurries were measured at 60° C. to obtain the results shown in Table 2. Incidentally, when no polyoxyethylene alkyl ether was added, the viscosity was 110 poises at 60° C.

TABLE 2

| Alkyl Group of Polyoxyethylene Alkyl Ether | Viscosity (poises) of Formed Slurry Average Molecular Weight 500 | 2000 | 4000 | 5000 | 6000 | 8000 | 10000 |
|---|---|---|---|---|---|---|---|
| Hexyl ($C_6$) | 98 | 85 | 70 | 59 | 58 | 58 | 60 |
| Octyl ($C_8$) | 100 | 85 | 70 | 59 | 58 | 57 | 59 |
| Lauryl ($C_{12}$) | 100 | 90 | 70 | 57 | 55 | 57 | 59 |
| Myristyl ($C_{14}$) | 100 | 90 | 72 | 58 | 56 | 56 | 60 |
| Palmityl ($C_{16}$) | 103 | 92 | 75 | 59 | 57 | 59 | 60 |
| Stearyl ($C_{18}$) | 105 | 95 | 72 | 59 | 58 | 58 | 60 |

From the results shown in Table 2, it will readily be understood that a polyoxyethylene alkyl ether having a molecular weight of 4,000 to 10,000 provides an AES-Na slurry having a viscosity of not more than 80 poises, and that if such a polyoxyethylene alkyl ether is used, the intended degree of viscosity of a surfactant slurry can be attained. It will also be understood that the degree of the viscosity does not depend on the alkyl group of the polyoxyethylene alkyl ether, but depends on the amount of ethylene oxide added.

The compositions comprising polyoxyethylene alkyl ethers having an average molecular weight of about 4,000 to about 10,000, which were found from the results shown in Table 2 to exert a viscosity-reducing effect, were subjected to the storage stability test. The storage stability was evaluated according to the centrifugal separation test (30 minutes' rotation at room temperature and 3,600 r.p.m.), which is one of the accelerated storage stability tests. The obtained results are shown in Table 3.

TABLE 3

| Alkyl Group in Polyoxyethylene Alkyl Ether | Separation Percentage (%) of Slurry Average Molecular Weight of Polyoxyethylene Alkyl Ether 4,000 | 6,000 | 10,000 |
|---|---|---|---|
| Hexyl | 4 | 4 | 9 |
| Octyl | 0 | 0 | 0 |
| Lauryl | 0 | 0 | 0 |
| Myristyl | 0 | 0 | 0 |
| Palmityl | 0 | 0 | 0 |
| Stearyl | 8 | 9 | 9 |

From the results shown in Table 3, it will readily be understood that the stability of the surfactant slurry depends on the carbon chain length of the alkyl group in the polyoxyethylene alkyl ether added and that, in order to obtain a slurry having a good storage stability, it is preferable to add a polyoxyethylene alkyl ether containing an alkyl group having 8 to 16 carbon atoms.

From the foregoing results, it is seen that in order to obtain an AES-Na slurry having a low viscosity and good storage stability, it is necessary to add a polyoxyethylene alkyl ether containing an alkyl group having 8 to 16 carbon atoms and having an average molecular weight of 4,000 to 10,000.

EXAMPLE 3

Oxo alcohol (tradename "Diadol 13") was subjected to fractional distillation to obtain a branched alcohol containing an alkyl group having 1 to 3 carbon atoms at the $\beta$-position (the total carbon number being 13) and a linear alcohol (the carbon number being 13). Ethylene oxide was added to the respective alcohols (the average number of moles of added ethylene oxide being 3.0)

according to customary procedures, and the resulting addition products were subjected to sulfonation and then neutralization (sodium hydroxide was used) to obtain branched AES and, linear AES. They were mixed at various mixing ratios and, by using these mixtures, slurries containing 68% of AES and 0 or 0.7% of a polyoxyethylene lauryl ether, having an average molecular weight of 6,000 with the balance being water, were prepared. The solubility in water and viscosity at 60° C. of each slurry were measured. The obtained results are shown in Table 4. The water solubility was determined in the following manner. Namely, the sample slurry was added to water maintained at 40° C. with stirring at 300 r.p.m., and the time (minutes) required for forming a homogeneous solution containing 10% of AES was measured.

| Composition of Slurry | |
|---|---|
| Component | Content |
| AES-Na | 68% |
| Additive | 0.7% |
| Sodium sulfate, unreacted oil and water | Balance |

TABLE 4

| Run No. | Branched AES/Linear AES Ratio | Amount (%) of Polyoxyethylene Lauryl Ether Added | Solubility In Water (minutes) | Viscosity (poises) |
|---|---|---|---|---|
| Present Invention | | | | |
| 1 | 0/100 | 0.7 | 40 | 78.0 |
| 2 | 30/70 | 0.7 | 30 | 65 |
| 3 | 40/60 | 0.7 | 22 | 61 |
| 4 | 50/50 | 0.7 | 18 | 59 |
| 5 | 100/0 | 0.7 | 9 | 48 |
| Comparison | | | | |
| 6 | 40/60 | 0 | 60 | 102 |
| 7 | 50/50 | 0 | 47 | 90 |

When these compositions were stored at 45° C. for 1 month, it was found that the compositions according to the present invention had good storage stability.

We claim:

1. An aqueous high concentration slurry of an alcohol ethoxysulfate comprising:

(a) at least 50% by weight based on the weight of the slurry of a higher alcohol ethoxysulfate and (b) 0.05 to 10% by weight based on the weight of the slurry of a polyoxyethylene alkyl ether having an average molecular weight of about 4,000 to about 10,000, the alkyl group of said ether having 8 to 16 carbon atoms.

2. A slurry according to claim 1, wherein the content of the polyoxyethylene alkyl ether in the slurry is in the range of from 0.1 to 5% by weight based on the weight of the slurry.

3. A slurry according to claim 1, wherein a higher alcohol, used for the preparation of the higher alcohol ethoxylate sulfate salt, is a long-chain branched alcohol represented by the following formula (I) or (II), or a long-chain alcohol mixture containing at least 35% by weight of the long-chain branched alcohol of the formula (I) or (II):

$$R_1CH(R_2)CH_2OH \quad \text{(I)}$$

wherein $R_1$ and $R_2$ stand for an alkyl group, the carbon number of $R_1$ is from 1 to 3 and the sum of the carbon number of $R_1$ and $R_2$ is from 7 to 18, and $$R_3CH(R_4)OH \quad \text{(II)}$$

wherein $R_3$ and $R_4$ stand for an alkyl group, the carbon number of $R_3$ is from 1 to 9 and the sum of the carbon numbers of $R_3$ and $R_4$ is from 8 to 19.

4. A slurry according to claim 1, wherein said higher alcohol ethoxysulfate (a) is prepared by adding ethylene oxide to a higher alcohol, sulfating the ethylene oxide-added higher alcohol and then neutralizing the sulfated product, the number of moles of ethylene oxide being not more than 10 per mole of the higher alcohol.

5. A slurry according to claim 4, wherein the polyoxyethylene alkyl ether (b) is incorporated in the form of an aqueous solution of 1 to 30% by weight concentration into the slurry, simultaneously with the neutralization of the sulfated product with an alkali in the course of preparing the higher alcohol ethoxysulfate.

* * * * *